US008931570B2

(12) United States Patent
Casciaro et al.

(10) Patent No.: US 8,931,570 B2
(45) Date of Patent: Jan. 13, 2015

(54) REACTIVE IN-FLOW CONTROL DEVICE FOR SUBTERRANEAN WELLBORES

(75) Inventors: Dario Casciaro, Abruzzo (IT); Murray K. Howell, Aberdeeen (GB)

(73) Assignee: Baker Hughes Incorporated, Houston, TX (US)

( * ) Notice: Subject to any disclaimer, the term of this patent is extended or adjusted under 35 U.S.C. 154(b) by 747 days.

(21) Appl. No.: 12/117,531

(22) Filed: May 8, 2008

(65) Prior Publication Data

US 2009/0277650 A1 Nov. 12, 2009

(51) Int. Cl.

| | |
|---|---|
| ***E21B 43/12*** | (2006.01) |
| ***E21B 17/18*** | (2006.01) |
| ***E21B 21/10*** | (2006.01) |
| ***E21B 34/08*** | (2006.01) |
| ***E21B 43/08*** | (2006.01) |

(52) U.S. Cl.

CPC ..... *E21B 21/103* (2013.01); *E21B 34/08* (2013.01); *E21B 43/08* (2013.01); *E21B 43/12* (2013.01)

USPC ..... 166/386; 166/53; 166/319; 166/373

(58) Field of Classification Search

USPC ..... 166/192, 316, 319, 373, 386, 387

See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,412,641 | A | 12/1946 | Spangler |
| 2,762,437 | A | 9/1956 | Egan et al. |

(Continued)

FOREIGN PATENT DOCUMENTS

| | | |
|---|---|---|
| CN | 1385594 | 12/2002 |
| GB | 1492345 | 11/1977 |

(Continued)

OTHER PUBLICATIONS

Optimization of Commingled Production Using Infinitely Variable Inflow Control Valves; M.M. J. J. NAUS, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — James G Sayre

(74) *Attorney, Agent, or Firm* — Mossman, Kumar & Tyler PC

(57) ABSTRACT

An apparatus for controlling fluid in-flow into a wellbore tubular includes a translating flow control element having one or more fluid conveying conduits; and a reactive element that actuates the flow control element. The reactive element may be responsive to a change in composition of the in-flowing fluid. The reactive element may change volume or shape when exposed to or not exposed to a selected fluid. The selected fluid may be oil, water, or some other fluid (e.g., liquid, gas, mixture, etc.). The reactive element may slide the flow control element such that a conduit formed on the flow control element changes length, which then changes a pressure differential across the flow control element.

19 Claims, 7 Drawing Sheets

(56) References Cited

U.S. PATENT DOCUMENTS 2,810,352 A 10/1957 Tumilson
2,814,947 A 12/1957 Stegemeier et al.
2,942,668 A 6/1960 Maly et al.
2,945,541 A 7/1960 Maly et al.
3,326,291 A 6/1967 Zandmer
3,385,367 A 5/1968 Kollsman
3,419,089 A 12/1968 Venghiattis
3,451,477 A 6/1969 Kelley
3,675,714 A 7/1972 Thompson
3,692,064 A 9/1972 Hohnerlein et al.
3,739,845 A 6/1973 Berry et al.
3,741,301 A 6/1973 Maly et al.
3,791,444 A 2/1974 Hickey
3,876,471 A 4/1975 Jones
3,918,523 A 11/1975 Stuber
3,951,338 A 4/1976 Genna
3,975,651 A 8/1976 Griffiths
3,987,854 A 10/1976 Callihan et al.
4,153,757 A 5/1979 Clark
4,173,255 A 11/1979 Kramer
4,180,132 A 12/1979 Young
4,186,100 A 1/1980 Mott
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,294,313 A 10/1981 Schwegman
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,782,896 A 11/1988 Witten
4,821,800 A 4/1989 Scott et al.
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,033,551 A 7/1991 Grantom
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,829,522 A 11/1998 Ross et al.
5,831,156 A 11/1998 Mullins
5,839,508 A 11/1998 Tubel et al.
5,865,254 A 2/1999 Huber et al.
5,873,410 A 2/1999 Iato et al.
5,881,809 A 3/1999 Gillespie et al.
5,896,928 A * 4/1999 Coon ..... 166/373
5,982,801 A 11/1999 Deak
6,065,535 A 5/2000 Ross
6,068,015 A 5/2000 Pringle
6,098,020 A 8/2000 Den Boer
6,109,350 A 8/2000 Nguyen et al.
6,112,815 A 9/2000 Boe et al.
6,112,817 A 9/2000 Voll
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 * 1/2003 Brockman ..... 166/250.15
6,516,886 B2 2/2003 Patel
6,581,681 B1 6/2003 Zimmerman et al.
6,581,682 B1 6/2003 Parent et al.
6,622,794 B2 9/2003 Zisk, Jr.
6,632,527 B1 10/2003 McDaniel et al.
6,635,732 B2 10/2003 Mentak
6,667,029 B2 12/2003 Zhong et al.
6,672,385 B2 1/2004 Kilaas et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,004,248 B2 2/2006 Hoffman et al.
7,011,076 B1 3/2006 Weldon et al.
7,084,094 B2 8/2006 Gunn et al.
7,128,151 B2 10/2006 Corbett
7,159,656 B2 1/2007 Eoff et al.
7,185,706 B2 3/2007 Freyer
7,290,606 B2 11/2007 Coronado et al.
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 8/2008 Henriksen et al.
7,413,022 B2 8/2008 Broome et al.
7,419,002 B2 9/2008 Dybevik et al.
7,426,962 B2 9/2008 Moen et al.
7,469,743 B2 12/2008 Richards
7,493,947 B2 2/2009 Ross
7,673,678 B2 3/2010 MacDougall et al.
7,762,341 B2 7/2010 Hammer
7,896,082 B2 3/2011 Lake et al.
7,913,765 B2 3/2011 Crow et al.
7,918,275 B2 * 4/2011 Clem ..... 166/250.15
7,942,206 B2 5/2011 Huang et al.
2001/0012439 A1 8/2001 Young et al.
2002/0020527 A1 2/2002 Kilaas et al.
2002/0125009 A1 9/2002 Wetzel et al.
2003/0221834 A1 12/2003 Hess et al.
2004/0035578 A1 2/2004 Ross et al.
2004/0052689 A1 3/2004 Yao
2004/0108107 A1 6/2004 Wittrisch
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0042798 A1 3/2006 Badalamenti et al.
2006/0048936 A1 3/2006 Fripp et al.
2006/0048942 A1 3/2006 Moen et al.
2006/0076150 A1 4/2006 Coronado

(56) References Cited

U.S. PATENT DOCUMENTS

| | | | | |
|---|---|---|---|---|
| 2006/0086498 | A1 | 4/2006 | Wetzel et al. | |
| 2006/0108114 | A1 | 5/2006 | Johnson | |
| 2006/0113089 | A1* | 6/2006 | Henriksen et al. | 166/386 |
| 2006/0118296 | A1 | 6/2006 | Dybevik et al. | |
| 2006/0133089 | A1 | 6/2006 | Reid | |
| 2006/0175065 | A1 | 8/2006 | Ross | |
| 2006/0180320 | A1 | 8/2006 | Hilsman et al. | |
| 2006/0185849 | A1 | 8/2006 | Edwards et al. | |
| 2006/0266524 | A1 | 11/2006 | Dybevik | |
| 2006/0272814 | A1 | 12/2006 | Broome et al. | |
| 2006/0273876 | A1 | 12/2006 | Pachla | |
| 2007/0012444 | A1 | 1/2007 | Horgan et al. | |
| 2007/0034385 | A1 | 2/2007 | Tips et al. | |
| 2007/0039732 | A1 | 2/2007 | Dawson et al. | |
| 2007/0039741 | A1 | 2/2007 | Hailey | |
| 2007/0044962 | A1 | 3/2007 | Tibbles | |
| 2007/0131434 | A1 | 6/2007 | MacDougall et al. | |
| 2007/0246210 | A1 | 10/2007 | Richards | |
| 2007/0246213 | A1 | 10/2007 | Hailey, Jr. | |
| 2007/0246225 | A1* | 10/2007 | Hailey et al. | 166/386 |
| 2007/0246407 | A1 | 10/2007 | Richards et al. | |
| 2007/0272408 | A1 | 11/2007 | Zazovsky et al. | |
| 2008/0035349 | A1 | 2/2008 | Richard | |
| 2008/0035350 | A1 | 2/2008 | Henriksen et al. | |
| 2008/0053662 | A1 | 3/2008 | Williamson et al. | |
| 2008/0061510 | A1 | 3/2008 | Li et al. | |
| 2008/0110614 | A1 | 5/2008 | Orban | |
| 2008/0135249 | A1 | 6/2008 | Fripp et al. | |
| 2008/0149323 | A1 | 6/2008 | O'Malley et al. | |
| 2008/0149351 | A1 | 6/2008 | Mayray et al. | |
| 2008/0236839 | A1 | 10/2008 | Oddie | |
| 2008/0236843 | A1* | 10/2008 | Scott et al. | 166/386 |
| 2008/0283238 | A1* | 11/2008 | Richards et al. | 166/228 |
| 2008/0296023 | A1 | 12/2008 | Willauer | |
| 2008/0314590 | A1 | 12/2008 | Patel | |
| 2009/0056816 | A1 | 3/2009 | Arov et al. | |
| 2009/0101355 | A1 | 4/2009 | Peterson et al. | |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 | 8/2009 | Garcia et al. | |
| 2009/0283275 | A1 | 11/2009 | Hammer | |
| 2010/0038086 | A1 | 2/2010 | Bunnell et al. | |
| 2010/0096140 | A1 | 4/2010 | Mack | |

FOREIGN PATENT DOCUMENTS

| | | | |
|---|---|---|---|
| GB | 2421527 | A | 6/2006 |
| GB | 2341405 | | 12/2007 |
| GB | 2448069 | A | 10/2008 |
| JP | 59089383 | B2 | 5/1984 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004018833 | A1 | 3/2004 |
| WO | WO 2006/015277 | | 7/2006 |

OTHER PUBLICATIONS

An Oil Selective Inflow Control System; Rune Freyer, Easy Well Solutions; Morten Fejerskkov, Norsk Hydro; Arve Huse, Attinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninkiijke/Shell Exploratie en Producktie Laboratorium; SPE Drilling & Completion, vol. 12, No. 1, March: pp. 13-18, 1997 Society of Petroleum Engineers.

Restarick, Henry, Halliburton Energy Services, SPE Member; SPE 29831 Horizontal Completion Options in Reservoirs With Sand Problems; Presented at the SPE Middle East Oil Show, Behrain, Mar. 11-14, 1995; Copyright 1995, Society of Petroleum Engineers, Inc.

Dikken, Ben J., SPE, Konninkijke/Shell E&P Laboratorium; Pressure Drop in Horizontal Well and Its Effect on Production Performance; Nov. 1990, JPT, Copyright 1990 Society of Petroleum Engineers; pp. 1426-1433.

"Rapid Swelling and Deswelling of Thermoreversible Hydrophobically Modified Poly(N-Isopropylacrylamide) Hydrogels Prepared by Freezing Polymerisation". Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer". Xue, W., Champ, S. amd Huglin, M. B. 2001, European Polymer Journal, 37(5) 869-875.

Dinarvand, R., D'Emanuele, A (1995) The use of thermoresponsive hydrogels for on-off release of molecules. J. Control. Rel. 36: 221-227.

Tanaka, T., Nishio, I., Sun, S.T., Ueno-Nisho, S. (1982) Collapse of gels in an electric field, Science. 218:467-469.

Ishihara,K., Hamada, N., Sato, S., Shinohara, I., (1984) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules, 17: 2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771": Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

REACTIVE IN-FLOW CONTROL DEVICE FOR SUBTERRANEAN WELLBORES

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it is desired to provide even drainage across a production zone and/or the ability to selectively close off or reduce in-flow within production zones experiencing an undesirable influx of water and/or gas.

The present disclosure addresses these and other needs of the prior art.

SUMMARY OF THE DISCLOSURE

In aspects, the present disclosure provides an apparatus for controlling a flow of a fluid into a wellbore tubular in a wellbore. In one embodiment, the apparatus may include a movable flow control element having at least one conduit configured to convey the fluid; and at least one reactive element that actuates the flow control element in response to a change in composition of the fluid. The at least one reactive element may expand when exposed to oil, water, or some other selected fluid (e.g., liquid, gas, mixture, etc.). The conduit may be formed as a helical channel. For instance, the helical channel may be formed on an outer surface of the flow control element. In one arrangement, the apparatus may include a housing having a cavity in which the flow control element translates (e.g., slides, moves, etc.). A portion of the cavity may be enlarged to form a space between the flow control element and an inner wall of the housing. The inner wall may confine the fluid in at least a portion of the at least one conduit. In embodiments, the flow control element may be configured to have a first position wherein the fluid flows a first distance in the at least one conduit, and a second position wherein the fluid flows a second distance longer than the first distance in the at least one conduit. In arrangements, the at least one reactive element may be disposed in a chamber configured to communicate with a wellbore annulus.

In aspects, the present disclosure also provides a method for controlling a flow of a fluid into a wellbore tubular. In one embodiment, the method may include controlling a flow of the fluid using a flow control element having at least one conduit configured to convey the fluid; and actuating the flow control element using at least one reactive element that is responsive to a change in composition of the fluid. In aspects, the at least one reactive element may slide the flow control element between a first position wherein the fluid flows a first distance in the at least one conduit, and a second position wherein the fluid flows a second distance longer than the first distance in the at least one conduit. In embodiments, the method may include exposing the at least one reactive element to a fluid in a wellbore annulus.

In aspects, the present disclosure further provides a system for controlling a flow of a fluid in a well. The system may include a wellbore tubular in the well; and a production control device positioned along the wellbore tubular. In one embodiment, the production control device may include a housing having a cavity; a flow control device positioned in the cavity, the flow control device having at least one conduit configured to convey fluid; and a reactive element coupled to the flow control device, the reactive element being configured to expand when exposed to oil. In one arrangement, the housing may include an opening communicating a fluid in a wellbore annulus to the reactive element. The housing may also substantially isolate the reactive element from a fluid in the cavity of the housing.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
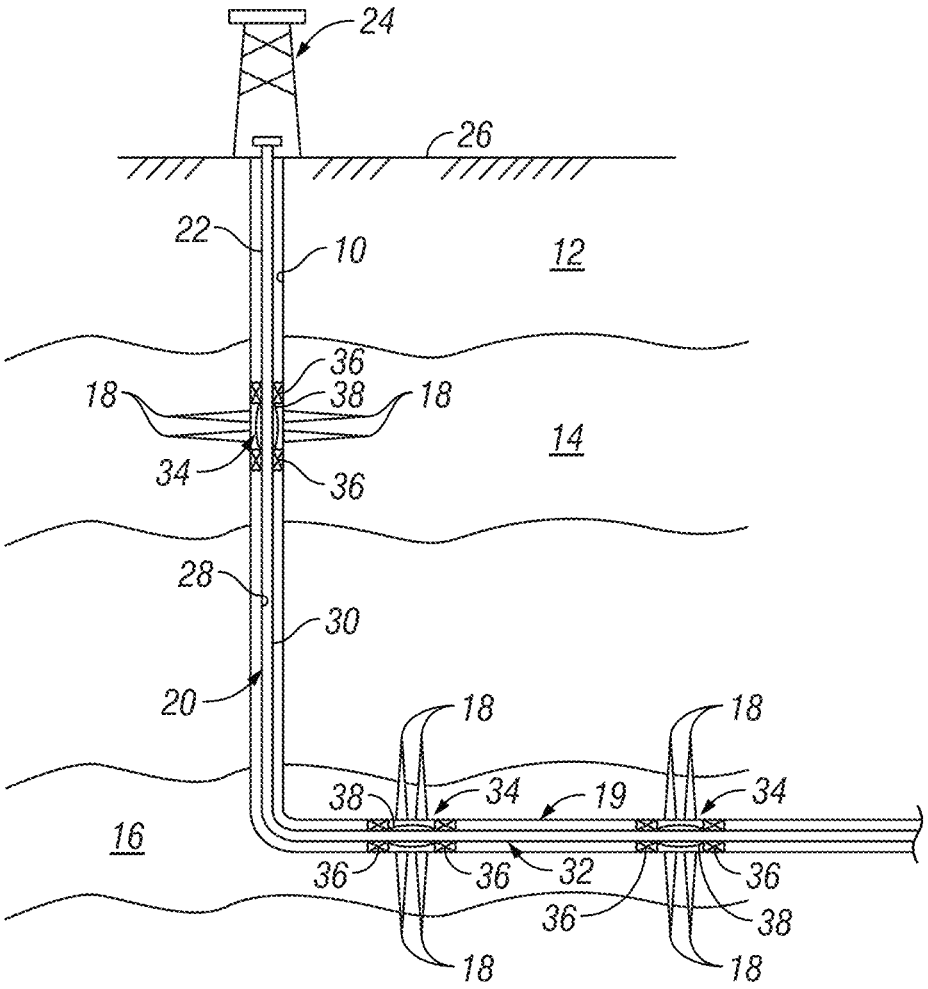
FIG. 1 is a schematic elevation view of an exemplary multi-zonal wellbore and production assembly which incorporates an in-flow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

In aspects, in-flow of water into a wellbore tubular of an oil well is controlled, at least in part using a reactive actuator that can interact with one or more components in fluids produced from an underground formation. The media interaction may be of any kind known to be useful to move, pressurize, push, displace or otherwise actuate a given device.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
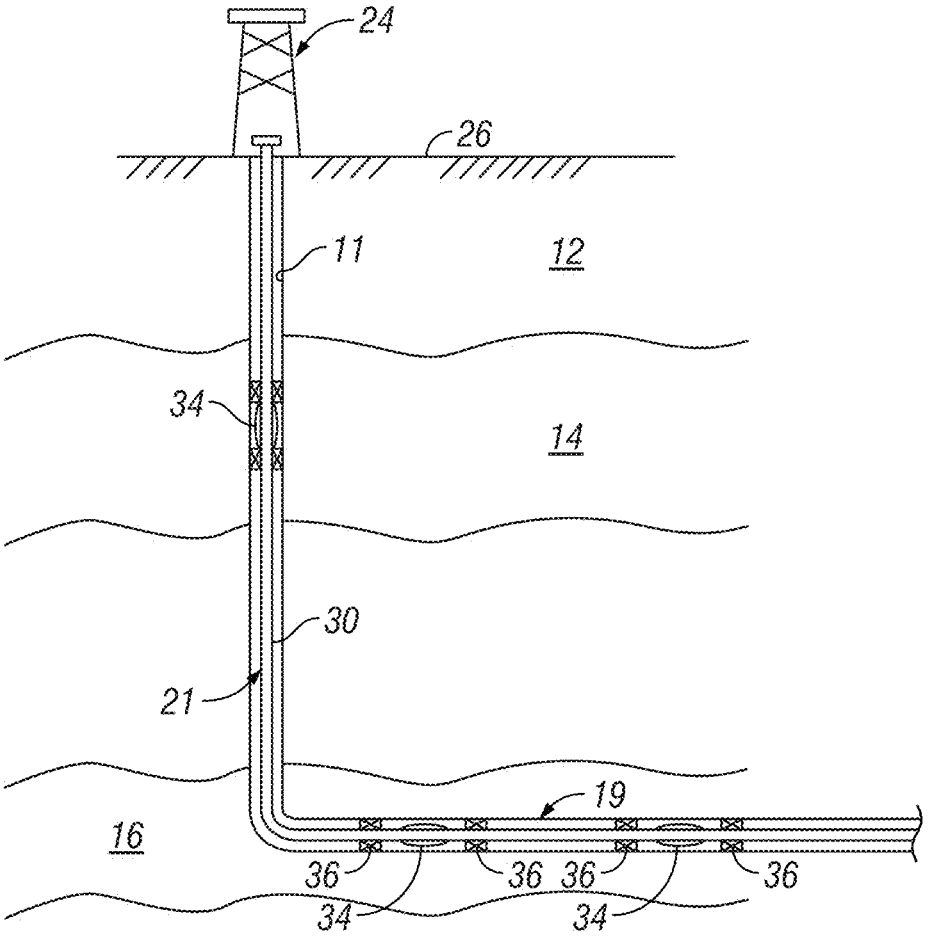
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
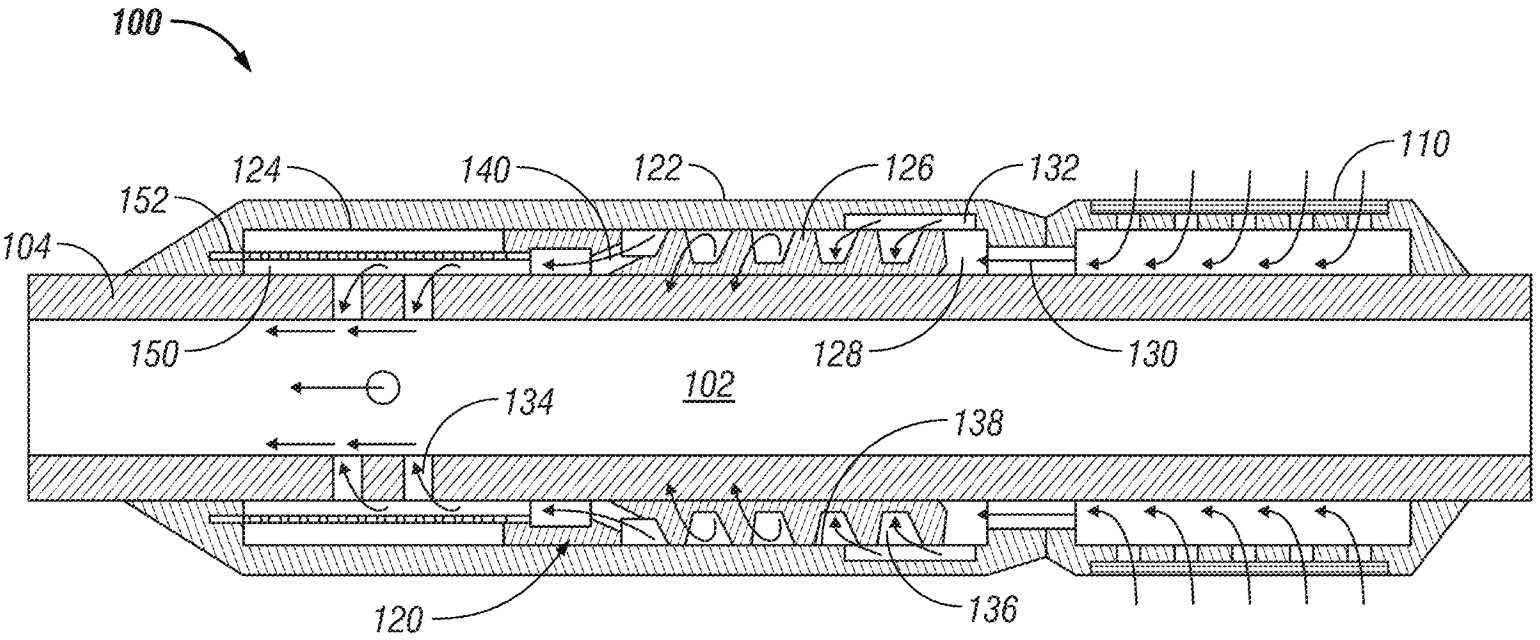
FIG. 3 is a schematic cross-sectional view of an exemplary in-flow control device made in accordance with one embodiment of the present disclosure that utilizes an oil reactive material.

Referring now to FIG. 3, there is shown one embodiment of a production control device 100 for controlling the flow of fluids from a reservoir into a flow bore 102 of a tubular 104 along a production string (e.g., tubing string 22 of FIG. 1). Flow may be controlled as a function of one or more characteristics or parameters of the formation fluid, including water content, oil content, gas content, etc. Furthermore, several production control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting in-flow of gas or water, a well owner can increase the likelihood that an oil bearing reservoir will drain efficiently. Exemplary production control devices are discussed in greater detail below.

In one embodiment, the production control device 100 includes a particulate control device 110 for reducing the amount and size of particulates entrained in the in-flowing fluids and an in-flow control device 120 that controls a drainage rate from the formation. The particulate control device 110 can include known devices such as sand screens and associated gravel packs.

The in-flow control device 120 may be configured to control flow through the production control device 100 as a function of the composition, concentration, fluid ratio, etc. of the in-flowing fluid. In one arrangement, the in-flow control device 120 may include a housing 122, a reactive element 124, and a flow control element 126. The housing 122 may be formed as a generally cylindrical member that include a cavity 128, an inlet 130, an enlarged diameter interior portion or port 132, and an outlet 134.

The flow control element 126 controls flow rates by modulating or adjusting a pressure differential or drop along the in-flow control device 120. In one arrangement, the flow control element 126 may be formed as a mandrel or tubular member that translates axially. The flow control element 126 may be configured to slide on the production tubular 104. In other embodiments, the flow control element 126 may slide along an inner sleeve or mandrel (not shown) of the housing 122. In one arrangement, the flow control element 126 may include one or more conduits 136 that channels fluid across the flow control element 126. For example, in one embodiment, the conduits 136 may be formed as helical channels formed on the outer surface of the flow control element 126 and that traverse the length of the flow control element 126. A single flow path may be used or two or more separate and independent flow paths may be utilized. The flow control element 126 may be received into the housing cavity 128 such that the conduits 136 are substantially the only path available for fluid to traverse the cavity 128. That is, an inner wall 138 of the housing 122 confines the fluid to flow only in the conduits 136. The conduits 136 convey the flowing fluid to an opening 140.

The flow control element 126 varies or controls the pressure differential in the flowing fluid by increasing or decreasing the effective distance a fluid must flow in the conduits 136 to reach the opening 140. This effective distance may be varied by controlling how much of a conduit 136 is exposed to or residing in the port 132. That is, the portion of a conduit 136 that is in the port 132 is removed from the distance a fluid has to travel in the conduit 136 in order to reach the opening 140. Thus, it should be appreciated that controlling the amount or length of the conduit 136 in the port 136 controls the choking or throttling effect of the in-flow control device 120. Decreasing the effective distance a fluid travels in the conduit 136 decreases the available pressure drop and increases the flow rate. Increasing the effective distance the fluid travels in the conduit 136 increases the pressure drop and decreases the flow rate.

The reactive element 124 actuates the flow control element 126 by selectively applying a translating force to the flow control element 126. The reactive element 124 may be coupled to or mated with the flow control element 126 such that a deformation (e.g., swelling, expanding, contraction, etc.) of the reactive element 124 moves, slides, displaces, pressurizes or shifts the flow control element 126 in a predetermined manner. In one embodiment, the reactive element 124 is formed of a material that swells, expands or otherwise increases in volume when exposed to oil; e.g., an oil reactive swellable elastomer. Thus, when exposed to fluids having mostly oil, the reactive element 124 may swell to a first length. When the fluid composition changes such that some or all of the oil is replaced or displaced by a non-oil, such as water or brine, the reactive element 124 may shrink to a second length that is shorter than the first length. The shrinking action may pull or slide the flow control element 126 such that amount of a conduit 136 in the port 132 is reduced, which increases the pressure drop and reduces the flow rate.

In one embodiment, the reactive element 124 may be formed as a sleeve that is positioned in a chamber 150 that is proximate to the outlet 134. The reactive element 124 may be secured within the chamber 150 with a retention element 152 that permits fluids (e.g., gas, liquids, mixtures, etc.) in the chamber 150 to interact with the reactive element 124. The retention element 152 may be a perforated sleeve, a permeable or semi-permeable membrane, or some other barrier, lining, screen or mesh that permits the fluid, or one or more specified components of the fluid, to interact with the reactive element 124. In some embodiments, the retention element 124 may be omitted. Additionally, configurations other than a sleeve may be used for the reactive element 124. Thus, configurations such as a strip, rod, or coil may also be utilized in certain applications.

In one mode of operation, the in-flow control device 120 controls flow rate such that the flow rate varies generally directly with the amount of oil in the fluid in the chamber 150. For example, when flowing fluid made up of mostly oil enters the in-flow control device 120, the reactive element 124 expands, if not already expanded, to an elongated or swollen shape that maintains the flow control element 126 in a base-line or normal flow-rate position. For instance, a relatively large amount of a conduit 136 may reside in the port 132. As the amount of oil in the flowing fluid drops, the reactive element 124 responds to the change by shrinking or contracting. This deformation pulls or slides the flow control element 126 such that the amount of the conduit 136 residing in the port 132 is reduced. The contracted reactive element 124, therefore, actuates the flow control element 126 into a minimal flow-rate position wherein a relatively small amount of a conduit 136 resides in the port 132.

Figure 4A:
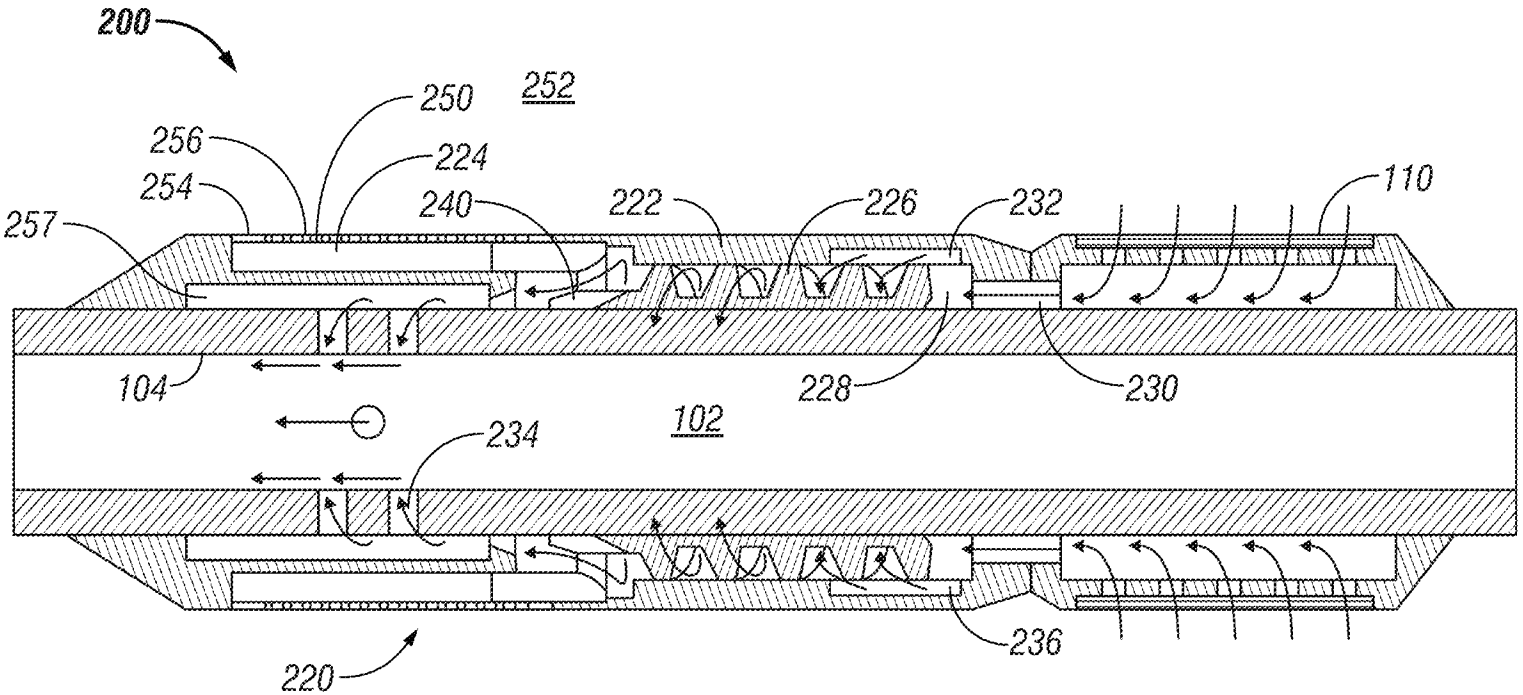
FIGS. 4A and 4B schematically illustrate a cross-sectional view of an exemplary in-flow control device made in accordance with one embodiment of the present disclosure that is responsive to fluid signals from a wellbore annulus.

Referring now to FIG. 4A, there is shown another embodiment of a production control device 200 for controlling the flow of fluids from a reservoir into a flow bore 102 of a tubular 104 along a production string (e.g., tubing string 22 of FIG. 1). As in the FIG. 3 embodiment, the production control device 200 includes a particulate control device 110 for reducing the amount and size of particulates entrained in the fluids. The production control device 200 also utilizes an in-flow control device 220 that may include a housing 222, a reactive element 224, and a flow control element 226. The housing 222 may be formed as a generally cylindrical member that includes a cavity 228, an inlet 230, an enlarged diameter interior portion that functions as a port 232, and an outlet 234.

In a manner similar to that described with reference to the embodiment illustrated in FIG. 3, the flow control element 226 controls a flow rate of the fluid in the in-flow control device 220 in response to changes in composition of the production fluid. In one arrangement, the flow control element 226 may include one or more conduits 236 that conveys fluid across the flow control element 226. As described previously, controlling the amount or length of the conduit 226 residing in the port 228 controls the choking or throttling effect of the in-flow control device 220.

The reactive element 224 actuates the flow control element 226 by selectively applying a translating force to the flow control element 226 and may be generally configured in a manner similar to the reactive element 124 of FIG. 3. However, the reactive element 224 may be positioned in a chamber 250 that communicates directly or indirectly with a wellbore annulus 252 via a window 254. The reactive element 224 may be secured within the chamber 250 with a retention element 256 that permits fluids (e.g., gas, liquids, mixtures, etc.) in the wellbore annulus 252 to interact with the reactive element 224. The reactive element 224 may be substantially isolated the fluid flowing in a housing interior 257. The retention element 256 may be configured as previously described or be omitted. Also, as noted previously, configurations other than a sleeve may be used for the reactive element 224.

Figure 4B:
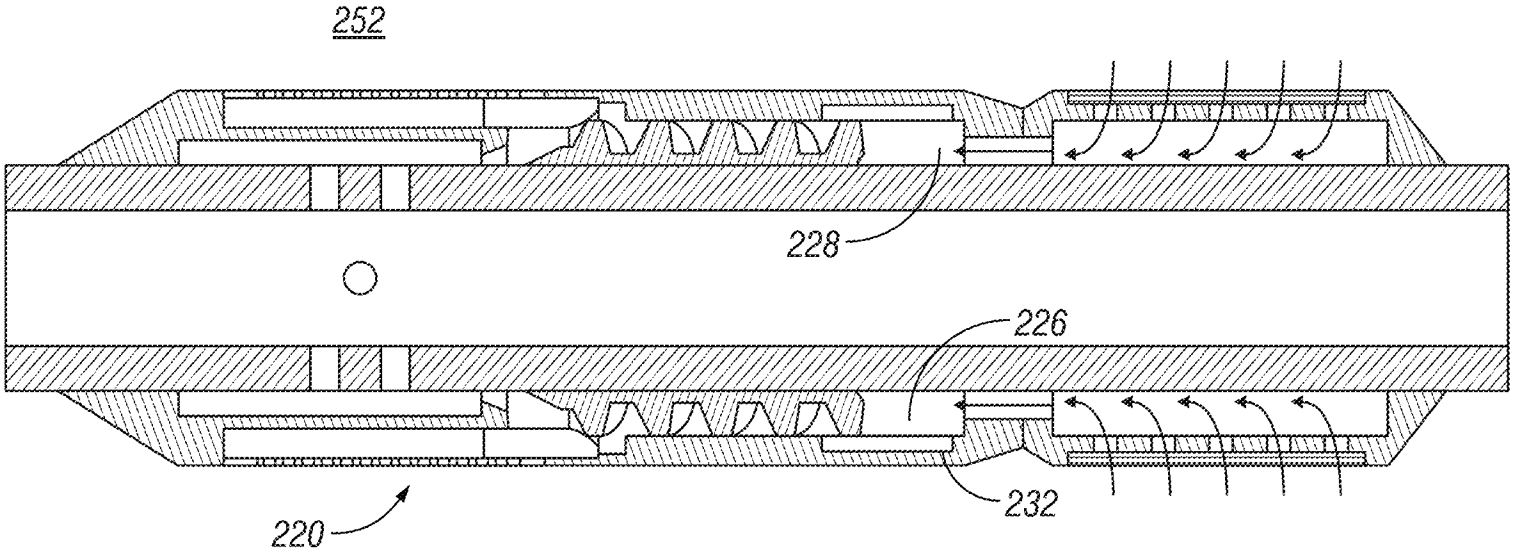

FIG. 4A illustrates the in-flow control device 220 in a generally base-line flow condition. That is, the flow control device 226 provides or establishes a flow rate desired for a fluid having a satisfactory concentration of oil. FIG. 4B illustrates the in-flow control device 220 in a generally restricted flow condition. That is, the flow control device 226 has reduced or stopped flow because the fluid in the wellbore annulus 252 does not have a satisfactory concentration of oil. It should be appreciated that, in some applications, the in-flow control device 220 may be configured to provide either a flow or substantially no flow condition. In other applications, the in-flow control device 220 may be configured to dynamic or proportionate flow condition depending on the concentration or content of a given fluid.

In one mode of operation, the in-flow control device 220 may be initially in the FIG. 4A position because mostly oil flows along the wellbore annulus 252. Due to the satisfactory concentration of oil, the reactive element 224 expands, if not already expanded, to an elongated or swollen shape that maintains the flow control element 226 in a base-line flow-rate position. That is, the effective flow distance across the flow control element 226 is relatively short and results in a relatively small pressure drop. As the amount of oil in the wellbore annulus 252 drops, the reactive element 224 responds to the change by shrinking or contracting. Referring now to FIG. 4B, this deformation pulls or slides the flow control element 226 such that one or more conduits 236 are withdrawn from the port 228. Because the effective flow distance across the in-flow flow control element 226 has increased, the pressure drop across the flow control device 220 also increases and restricts fluid in-flow.

Figure 5:
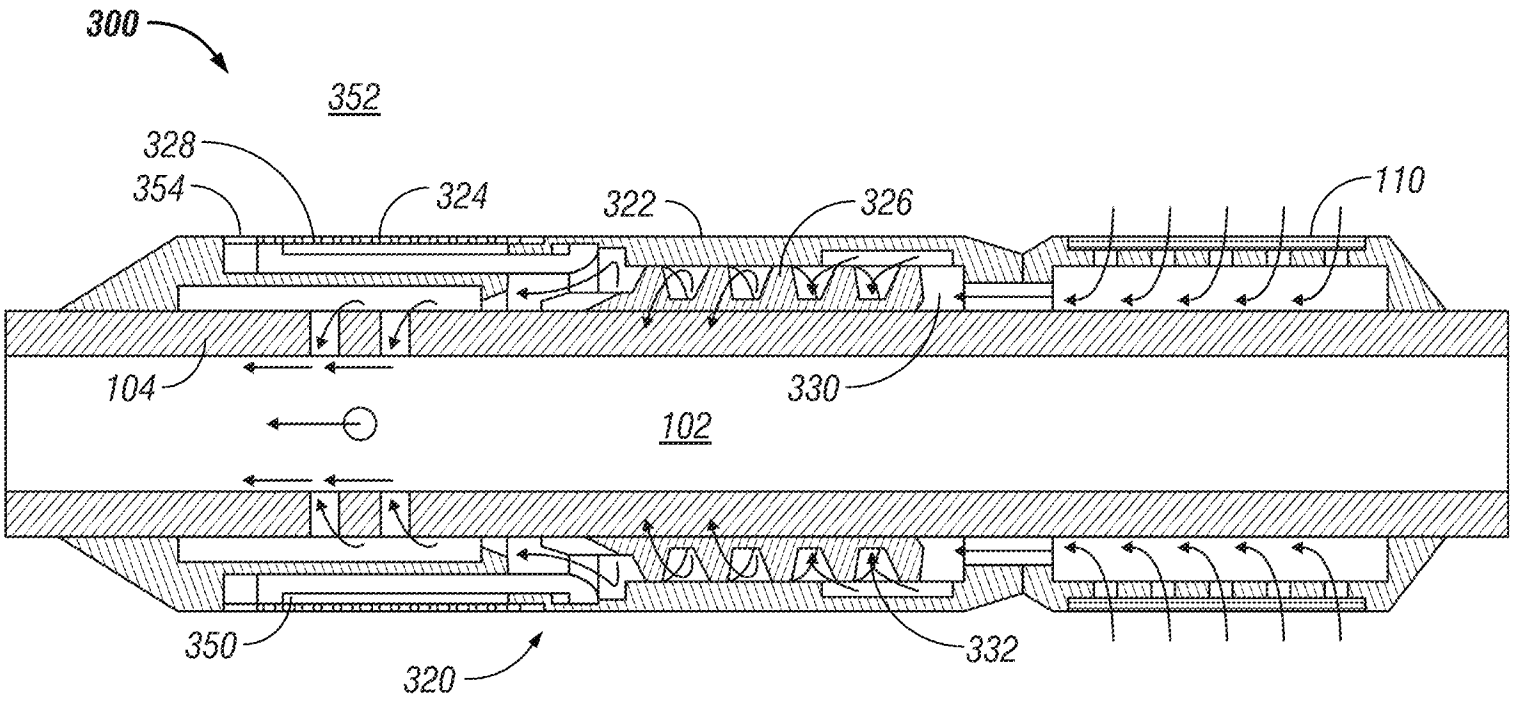
FIG. 5 schematically illustrates a cross-sectional view of another exemplary in-flow control device made in accordance with one embodiment of the present disclosure that utilizes a water reactive material.

Referring now to FIG. 5, there is shown yet another embodiment of a production control device 300 for controlling the flow of fluids from a reservoir into a flow bore 102 of a tubular 104 along a production string (e.g., tubing string 32 of FIG. 1). The FIG. 5 embodiment is generally similar to that shown in FIG. 4. However, the production control device 300 utilizes a reactive element that swells or deforms when exposed to water rather than oil. The in-flow control device 320 may include a housing 322, a reactive element 324, and a flow control element 326.

Similar to the embodiment of FIG. 4A, the reactive element 324 may be formed as a sleeve that is positioned in a chamber 350 that communicates directly or indirectly with a wellbore annulus 352 via a window 354. One end of the reactive element 324 is fixed to the housing 352 and the other end engages a piston element 328. The piston element 328 is connected to the flow control element 326. Thus, the piston element 328 and the flow control element 326 translate or slide together. Because the reactive element 324 is formed of a material that swells in water, the reactive element 324 is in a non-activated condition when exposed to oil. When exposed to water in a sufficient amount or concentration, the reactive element 324 expands; e.g., increase in length or volume. The expanding reactive element 328 urges the piston element 328 such that the flow control element 326 is drawn out of a port 330 in the housing 322. Thus, as before, the in-flowing fluid traverses a longer distance across the flow control element 326 via the conduits 332, which increase a pressure differential thereacross and restricts or stops fluid flow.

It should be appreciated that the FIG. 3 embodiment of the in-flow control device 120 is merely illustrative and that other embodiments may utilize different configurations.

Figure 6:
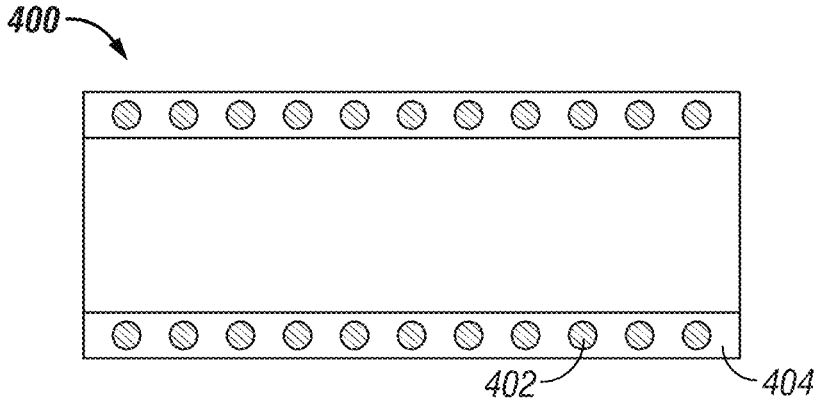
FIG. 6 is a schematic cross sectional view of an exemplary embodiment of a reactive element according to the present the disclosure.

For example, referring now to FIG. 6 there is shown an embodiment of a reactive element 400 that utilizes a biasing member 402 that is at least partially incased in a material 404 that is relatively rigid when exposed to oil. The biasing member 402 may be a spring that is held in tension by the relatively rigid material 404. If the material 404 is not exposed to oil, or a predetermined concentration of oil, the material 404 may become pliable and allow the biasing member 402 to return to a relaxed or non-activated condition, which may pull or slide the flow control element 126 (FIG. 3) in a desired manner. Of course, the material 404 may also be selected to be reactive with water or some other fluid.

While the teachings of the present disclosure have been discussed in the context of in-flow control devices used in a production phase of a well, it should be understood that the methods, devices and systems of the present disclosure may be advantageously applied to numerous activities, e.g., drilling, completion, logging, re-completion, work-over, etc. and tools utilized in such wellbore applications.

Figure 7:
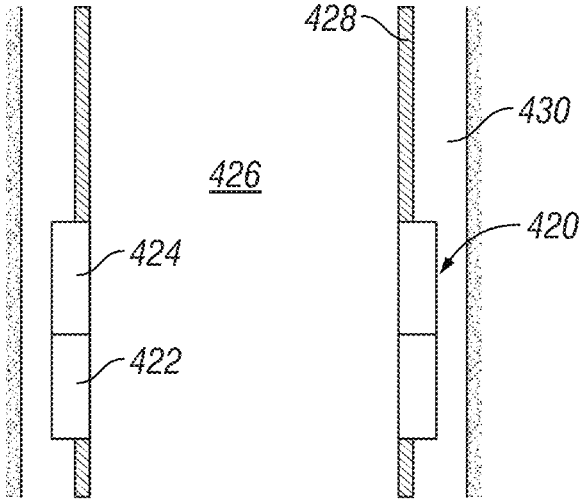
FIG. 7 schematically illustrates an embodiment of a reactive element actuator that may be utilized to actuate a wellbore device according to the present disclosure.

Referring now to FIG. 7, there is in a generalized schematic form a wellbore tool 420 that utilizes a reactive element 422 to actuate an apparatus or device 424. The device 424 may be a packer, a slip, a liner hanger, a sliding sleeve valve, or any other device configured to perform one or more operations in the wellbore. The reactive element 422 may be configured to actuate the device 424 by applying a force that moves the device in a predetermined manner; e.g., slide, rotate, bend, etc.

The reactive element 422 may also be configured as a switch-type of device that releases or activates a separate actuator. For example, the reactive element 422 may be configured to open a valve that directs a fluid, such as a wellbore fluid at hydrostatic pressure, into an actuator that uses a hydraulic chamber. The reactive element 422 may also be configured to release a stored energy in the form of a biasing element, a pyrotechnic device, a pressurized fluid (e.g., nitrogen gas), etc. Thus, in embodiments, the reactive element 422 may directly actuate or indirectly actuate the device 424. In still other variants, the reactive element 422 may be utilized to selectively compress a fluid into a closed reservoir or hydraulic chamber formed inside a tool. A sleeve or piston-like member may be displaced by the increased pressure in the closed reservoir. In still other variants, a reactive fluid (e.g., a liquid, gel, etc.) may be interposed between the reactive element 422 and the formation fluid. In such a variant, the reactive fluid applies a stimulus to the reactive element 422 when the reactive fluid interacts with a particular formation fluid or fluids.

Additionally, the reactive element 422 may be configured to react with a fluid or fluids in the bore 426 of a wellbore tubular 428 and/or in a wellbore annulus 430. While materials that swell or expand when exposed to oil or water have been discussed, it should be appreciated that other fluids (e.g., liquids, gases, mixtures, etc.) may also be used to provide a signal that causes a specified expansion, contraction, or other type of deformation, of the reactive element 422. For example, the reactive element 422 may be configured to react with drilling mud, fracturing fluid, acids, cement, methane gas, lost circulation material, etc.

From the above, it should be appreciated that what has been described includes, in part, an apparatus for controlling in-flow of a fluid into a wellbore tubular. In one embodiment, the apparatus may include a translating flow control element and a reactive element that actuates the flow control element. The flow control element may include one or more fluid conveying conduits and the reactive element may be responsive to a change in composition of the fluid. For example, the reactive element may have a first volume when exposed to a fluid and then contract to a second smaller volume when that fluid is no longer present in sufficient concentration. The reactive element may expand when exposed to oil, water, or some other selected fluid (e.g., liquid, gas, mixture, etc.).

From the above, it should be appreciated that what has been described also includes, in part, method for controlling a flow of a fluid into a wellbore tubular. The method may include controlling a flow of the fluid using a flow control element having at least one conduit configured to convey the fluid; and actuating the flow control element using at least one reactive element that is responsive to a change in composition of the fluid. In aspects, the at least one reactive element may slide the flow control element between a first position wherein the fluid flows a first distance in the at least one conduit, and a second position wherein the fluid flows a second distance longer than the first distance in the at least one conduit. In embodiments, the method may include exposing the at least one reactive element to a fluid in a wellbore annulus.

From the above, it should be appreciated that what has been described further includes, in part, a system for controlling a flow of a fluid in a well. The system may include a wellbore tubular in the well; and a production control device positioned along the wellbore tubular. In one embodiment, the production control device may include a flow control device positioned in a cavity of a housing. The flow control device may have at least one conduit configured to convey fluid and a reactive element coupled to the flow control device, the reactive element being configured to expand when exposed to oil. In one arrangement, the housing may include an opening communicating a fluid in a wellbore annulus to the reactive element. The housing may also substantially isolate the reactive element from a fluid in the cavity of the housing.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid from a wellbore annulus into a tubular in a wellbore, comprising:

a housing having an outlet in communication with a flow bore of the tubular, a cavity, and a port receiving the fluid from the wellbore annulus;

a movable flow control element disposed in the cavity and having at least one conduit configured to convey the fluid received from the port to the outlet, wherein translation of the flow control element varies an amount of the at least one conduit in fluid communication with the port, wherein the amount of the at least one conduit in fluid communication with the port varies an effective distance the fluid travels from the port to the outlet; and at least one reactive element being configured to actuate the flow control element to vary a length of the flow control element in fluid communication with the port in response to a change in composition of the fluid.

2. The apparatus of claim 1 wherein the at least one reactive element contracts when the amount of oil in the fluid drops, and wherein the at least one reactive element slides the flow control element to reduce the length of the flow control element in fluid communication with the port.

3. The apparatus of claim 1 wherein the at least one conduit is a helical channel.

4. The apparatus of claim 3 wherein the flow control element includes an outer surface, and wherein the helical channel is formed on the outer surface.

5. The apparatus of claim 1, wherein the reactive element applies a translating force to the flow control element, the flow control element translating in the cavity in response to the applied translating force.

6. The apparatus of claim 5 wherein the port is a portion of the cavity that is enlarged to form a fluid flow space between the flow control element and an inner wall of the housing.

7. The apparatus of claim 5 wherein an inner wall defines the cavity and wherein the inner wall is configured to confine the fluid in the at least one conduit, and wherein the reactive element is positioned in a chamber adjacent to the cavity.

8. The apparatus of claim 1 wherein the flow control element is configured to have a first position wherein the fluid flows a first distance in the at least one conduit to an opening in the wellbore tubular, and a second position wherein the fluid flows a second distance longer than the first distance in the at least one conduit to the opening in the wellbore tubular.

9. The apparatus of claim 1 wherein the at least one reactive element is disposed in a chamber configured to communicate with a wellbore annulus.

10. A method for controlling a flow of a fluid from a wellbore annulus into a tubular in a wellbore, comprising:

controlling a flow of the fluid using a flow control element having at least one conduit configured to convey the fluid, wherein the flow control element is disposed in a housing having an outlet in communication with a flow bore of the tubular, a cavity, and a port, and wherein the at least one conduit is in selective fluid communication with the port;

and actuating the flow control element using at least one reactive element to vary a length of the flow control element in fluid communication with the port, wherein an amount of the at least one conduit in fluid communication with the port varies an effective distance the fluid travels from the port to the outlet, the at least one reactive element being responsive to a change in composition of the fluid.

11. The method of claim 10 wherein the at least one reactive element contracts when the amount of oil in the fluid drops.

12. The method of claim 10 wherein the at least one conduit is a helical channel.

13. The method of claim 10, wherein the flow control element is configured to translate in the cavity.

14. The method of claim 10 wherein the at least one conduit terminates at an opening in the tubular, and wherein varying the distance the fluid flows to the opening varies a pressure differential in the fluid.

15. The method of claim 10 wherein the at least one reactive element slides the flow control element between a first position wherein the fluid flows a first distance in the at least one conduit, and a second position wherein the fluid flows a second distance longer than the first distance in the at least one conduit.

16. The method of claim 10 further comprising exposing the at least one reactive element to a fluid in a wellbore annulus.

17. A system for controlling a flow of a fluid in a well, comprising:

a wellbore tubular in the well;

a production control device positioned along the wellbore tubular, the production control device including:

(i) a housing having an outlet in communication with a flow bore of the tubular, a port and a cavity;

(ii) a flow control element positioned in the cavity, the flow control element having at least one conduit configured to convey the fluid received from the port, wherein translation of the flow control element varies an amount of the at least one conduit in fluid communication with the port, wherein the amount of the at least one conduit in fluid communication with the port varies an effective distance the fluid travels from the port to the outlet; and (iii) a reactive element coupled to the flow control device, the reactive element being configured to vary a distance the fluid flows in the at least one conduit, the at least one reactive element responsive to a change in composition of the fluid.

18. The system of claim 17 wherein the housing includes an opening communicating a fluid in a wellbore annulus to the reactive element; and wherein the reactive element is substantially isolated from a fluid in the cavity of the housing.

19. The system of claim 17 wherein the flow control device is configured to slide between a first position wherein the fluid flows a first distance in the at least one conduit, and a second position wherein the fluid flows a second distance longer than the first distance in the at least one conduit.

* * * * *